US008991658B2

(12) United States Patent
Saito et al.

(10) Patent No.: US 8,991,658 B2
(45) Date of Patent: Mar. 31, 2015

(54) LIQUID SUPPLY SYSTEM

(75) Inventors: Kenji Saito, Tokyo (JP); Shinji Nishida, Tokyo (JP); Koichi Mori, Tokyo (JP)

(73) Assignee: Eagle Industry Co., Ltd., Tokyo (JP)

( * ) Notice: Subject to any disclaimer, the term of this patent is extended or adjusted under 35 U.S.C. 154(b) by 0 days.

(21) Appl. No.: 13/884,208

(22) PCT Filed: Jan. 16, 2012

(86) PCT No.: PCT/JP2012/050738

§ 371 (c)(1),
(2), (4) Date: May 8, 2013

(87) PCT Pub. No.: WO2012/124363

PCT Pub. Date: Sep. 20, 2012

(65) Prior Publication Data

US 2014/0054318 A1 Feb. 27, 2014

(30) Foreign Application Priority Data

Mar. 15, 2011 (JP) ..... 2011-056426
Sep. 30, 2011 (JP) ..... 2011-216621

(51) Int. Cl.

| | |
|---|---|
| ***B65D 37/00*** | (2006.01) |
| ***B67D 7/82*** | (2010.01) |
| ***F04B 15/08*** | (2006.01) |
| ***F25D 17/02*** | (2006.01) |
| *F25D 19/00* | (2006.01) |

(52) U.S. Cl.

CPC . *B67D 7/82* (2013.01); *F04B 15/08* (2013.01); *F25D 17/02* (2013.01); *F25D 19/00* (2013.01); *F04B 2015/0824* (2013.01); *F04B 2015/082* (2013.01)

USPC ..... 222/207; 222/146.6; 222/146.1; 222/633

(58) Field of Classification Search

CPC ... B67D 7/80; F04B 15/08; F04B 2015/0824; F04B 43/0045; F04B 43/026; F25D 17/02

USPC ..... 123/193.1, 193.6; 222/136, 137, 142.5, 222/146.2, 190, 195, 207, 213, 632, 633, 222/634; 92/248–249; 62/118, 121, 390, 62/430, 616

See application file for complete search history.

(56) References Cited

U.S. PATENT DOCUMENTS

| | | | | |
|---|---|---|---|---|
| 5,222,466 | A * | 6/1993 | Gratziani | 123/193.6 |
| 5,746,728 | A * | 5/1998 | Py | 604/298 |
| 2005/0028879 | A1 * | 2/2005 | Suzuki | 138/26 |

FOREIGN PATENT DOCUMENTS

| | | | |
|---|---|---|---|
| JP | 62121877 | A | 6/1987 |
| JP | 63120875 | A | 5/1988 |

(Continued)

*Primary Examiner* — Frederick C Nicolas
*Assistant Examiner* — Bob Zadeh
(74) *Attorney, Agent, or Firm* — Harness, Dickey & Pierce, P.L.C.

(57) ABSTRACT

A space-saving liquid supply system includes increased cooling efficiency. A first pump chamber P1 is formed by an outside of a bellows 130 in a second vessel 120 and the first pump chamber P1 is provided with a first intake port 121 for taking the liquid in the first vessel 110 into the first pump chamber P1 and a first delivery port 122 for delivering the taken-in liquid L from inside the first pump chamber P1 into a supply passage K1. A second pump chamber P2 is formed by a sealed space in the bellows 130 and the second pump chamber P2 is provided with a second intake port 123 for taking the liquid L in the first vessel 110 into the second pump chamber P2 and a second delivery port 124 for delivering the taken-in liquid from inside the second pump chamber P2 into the supply passage K1.

9 Claims, 7 Drawing Sheets

(56) References Cited

FOREIGN PATENT DOCUMENTS

| | | | |
|---|---|---|---|
| JP | 05087054 | A | 4/1993 |
| JP | 07077201 | A | 3/1995 |
| JP | 2004075149 | A | 3/2004 |
| JP | 2004286372 | A | 10/2004 |
| JP | 2008215640 | A | 9/2008 |

* cited by examiner

LIQUID SUPPLY SYSTEM

CROSS-REFERENCE TO RELATED APPLICATIONS

This application is a National Stage of International Application No. PCT/JP2012/050738, filed Jan. 16, 2012, which claims the benefit and priority of Japanese Patent Application No. 2011-056426, filed Mar. 15, 2011 and Japanese Patent Application No. 2011-216621, filed Sep. 30, 2011. The entire disclosures of each of the above applications are incorporated herein by reference.

TECHNICAL FIELD

The present disclosure relates to a liquid supply system for supplying ultracold liquid such as liquid nitrogen and liquid helium.

Conventionally, there is a known technique for supplying ultracold liquid such as liquid nitrogen into a vessel, in which a superconducting coil or the like is housed, in order to maintain the superconducting coil or the like in an ultracold state (see Patent Literature 1). With reference to FIG. 7, a prior-art liquid supply system as disclosed in Japanese Patent Application Laid-Open No. 2008-215640 will be described. FIG. 7 is a schematic block diagram showing a state of use of the prior-art liquid supply system.

The prior-art liquid supply system 500 constantly supplies ultracold liquid L into a resin vessel 310 in order to maintain a superconducting coil 320 in a superconductive state in a cooled device 300 including the superconducting coil 320 in the vessel 310.

The liquid supply system 500 includes a first vessel 510 for housing the ultracold liquid L, a second vessel 520 disposed in the liquid L housed in the first vessel 510, and a bellows 530 disposed to enter the second vessel 520. An area in the second vessel 520 and outside the bellows 530 forms a pump chamber P. The second vessel 520 is provided with an intake port 521 for taking the liquid L into the pump chamber P and a delivery port 522 for delivering the taken-in liquid L from inside the pump chamber P into a supply passage K1 communicating with an outside of the system. The intake port 521 and the delivery port 522 are respectively provided with one-way valves 521*a* and 522*a*.

A shaft 550 which is caused to reciprocate by a driving source 540 enters the bellows 530 from outside the first vessel 510 and a tip end of the shaft 550 is fixed to a tip end of the bellows 530. In this way, when the shaft 550 reciprocates, the bellows 530 expands and contracts.

With the above-described structure, when the bellows 530 contracts, a volume of the pump chamber P increases and the liquid L in the first vessel 510 is taken into the pump chamber P through the intake port 521. When the bellows 530 expands, the volume of the pump chamber P reduces and the liquid in the pump chamber P is delivered into the supply passage K1 through the delivery port 522. In this manner, by repetition of expansion and contraction of the bellows 530, the liquid L is supplied to the cooled device 300 through the supply passage K1. A return passage K2 connecting the liquid supply system 500 and the cooled device 300 is provided as well and the same amount of liquid L as that supplied to the cooled device 300 is returned to the first vessel 510 of the liquid supply system 500. A cooling device 200 for cooling the liquid L into the ultracold state is provided at a position of the supply passage K1. With this structure, the liquid L cooled to an ultracold temperature by the cooling device 200 circulates between the liquid supply system 500 and the cooled device 300.

In the liquid supply system 500 formed as described above, by expansion and contraction of the bellows 530, the liquid L is supplied intermittently to the cooled device 300 through the supply passage K1. In other words, liquid pressure in the supply passage K1 alternately becomes high and low, which causes what is called pulsations. Therefore, if the resin vessel 310 is formed by bonding two resin molded products together by using an adhesive, a load of pressure due to the pulsations may cause a low-temperature brittle fracture. To cope with this, variation in the pressure is suppressed by providing a damper 600 to the supply passage K1 in the prior art.

However, because the damper 600 is provided to the supply passage K1 connecting the liquid supply system 500 and the cooled device 300 in the prior art, an extra installation space is required and also heat exchange is carried out at the damper 600 to reduce cooling efficiency.

SUMMARY

Technical Problem

It is an object of the present disclosure to provide a space-saving liquid supply system with increased cooling efficiency.

Solution to Problem

The present disclosure employs the following means to achieve the above-described object.

Specifically, according to the present disclosure, there is provided a liquid supply system including: a first vessel in which ultracold liquid is housed; a second vessel disposed in the liquid housed in the first vessel to take in the liquid and to deliver the taken-in liquid into a supply passage communicating with an outside of the system; a bellows disposed to enter the second vessel; and a shaft formed to be reciprocated by a driving source to cause the bellows to expand and contract, wherein an outside of the bellows in the second vessel serves as a first pump chamber provided with a first intake port for taking the liquid in the first vessel into the first pump chamber and a first delivery port for delivering the taken-in liquid from inside the first pump chamber into the supply passage, and an inside of the bellows serves as a second pump chamber formed by a sealed space and provided with a second intake port for taking the liquid in the first vessel into the second pump chamber and a second delivery port for delivering the taken-in liquid from inside the second pump chamber into the supply passage.

According to the present disclosure, the liquid is delivered from inside the second pump chamber into the supply passage and the liquid is taken into the first pump chamber when the bellows contracts while the liquid is taken into the second pump chamber and the liquid is delivered from the first pump chamber into the supply passage when the bellows expands. Therefore, it is possible to double an amount of liquid supplied by the expansion and contraction of the bellows as compared with the case in which the pump function is performed only by the first pump chamber. Moreover, while the liquid is intermittently supplied when the pump function is performed only by the first pump chamber, the liquid is supplied both when the bellows contracts and expands in the invention. Therefore, the liquid is supplied continuously, which suppresses pulsations themselves. As a result, a damper need not be provided outside the system, which saves space as compared with the case in which the damper is provided outside the system and increases cooling efficiency.

A sealed space through which the shaft extending from outside the first vessel to reach the bellows is inserted and an inside of which is filled with gas may be formed.

In this way, the sealed space filled with the gas exerts heat insulating effect, which suppresses vaporization of the liquid due to heating in the first pump chamber and the second pump chamber. Therefore, it is possible to suppress deterioration of the pump function.

A sealed space through which the shaft extending from outside the first vessel to reach the bellows is inserted and an inside of which is evacuated may be formed.

In this way, the evacuated sealed space exerts the heat insulating effect, which suppresses vaporization of the liquid due to heating in the first pump chamber and the second pump chamber. Therefore, it is possible to suppress deterioration of the pump function. The evacuated sealed space has more heat insulating effect than the sealed space filled with the gas.

A sealed space through which the shaft extending from outside the first vessel to reach the bellows is inserted is formed, a layer of the liquid and a layer of gas are formed in the sealed space, and a branch passage branching off the supply passage is connected to the sealed space to form a buffer structure for buffering pressure variation of the liquid supplied through the supply passage.

According to the present disclosure, the buffer structure for buffering the pressure variation (pulsations) of the liquid supplied through the supply passage is provided in the system. Therefore, while saving space and increasing the cooling efficiency, it is possible to suppress the pulsations in cooperation with the above-described suppression of the pulsations themselves in a synergistic manner. Even if transfer of heat from a driving source or the atmosphere to the shaft due to reduction of a liquid level in the first vessel causes vaporization of the inside liquid, it merely increases a thickness of the layer of the gas for performing the buffering function (the function as a gas damper) in the above-described sealed space and vaporization in the pump chamber is suppressed. Therefore, the pump function is not deteriorated.

The buffer structure may be provided with a safety valve for allowing internal pressure to escape to the outside when the pressure in the sealed space through which the shaft is inserted becomes equal to or higher than predetermined pressure.

In this way, even if the pressure in the sealed space becomes abnormally high due to increase of an amount of the vaporized gas or the like in the sealed space, it is possible to allow the pressure to escape. Therefore, it is possible to suppress breakage or the like of respective members due to abnormally high internal pressure.

The sealed space through which the shaft is inserted and the second pump chamber may be separated by a small bellows, the sealed space and an outside space are separated by a small bellows, and both the bellows expand and contract as the shaft reciprocates and have smaller outer diameters than the bellows.

In this way, it is possible to form the sealed space through which the shaft is inserted without forming sliding portions, which avoids generation of heat caused by frictional resistance due to sliding.

A heater for adjusting a temperature may be provided near the small bellows separating the sealed space and the outside space from each other.

In this way, it is possible to suppress (prevent) adhesion of frost and lumps of ice to the small bellows to suppress breakage the small bellows. Moreover, it is possible to adjust thicknesses of the layers of the liquid and the gas in the structure in which the layer of the liquid and the layer of the gas are formed in the sealed space as described above. In this way, it is possible to adjust the thicknesses of the respective layers according to the pulsations which would occur if the damper was not provided to effectively suppress the variation (pulsations) of the pressure.

A shaft member and a bearing of the shaft member may be provided below the bellows.

In this way, it is possible to suppress displacement of axes of the shaft and the bellows in reciprocation of the shaft.

A bottom side of the second vessel and the bellows may be connected by a small bellows which communicates with the inside of the first vessel, expands and contracts as the shaft reciprocates, and has a smaller outer diameter than the bellows.

In this way, it is possible to reduce a pump rate of the first pump chamber to reduce a difference from a pump rate of the second pump chamber. Therefore, it is possible to further suppress the pulsations.

The above-described respective structures can be employed in combination wherever possible.

Advantageous Effects of the Present Disclosure

As described above, with the present disclosure, it is possible to increase the cooling efficiency while saving space.

DESCRIPTION OF EMBODIMENTS

Modes for carrying out the present disclosure will be specifically described below based on embodiments with reference to the drawings. However, dimensions, materials, shapes, and relative positions of component parts described in the embodiments are not intended to restrict a scope of the invention to only themselves unless otherwise specified.

Embodiment 1

Figure 1:
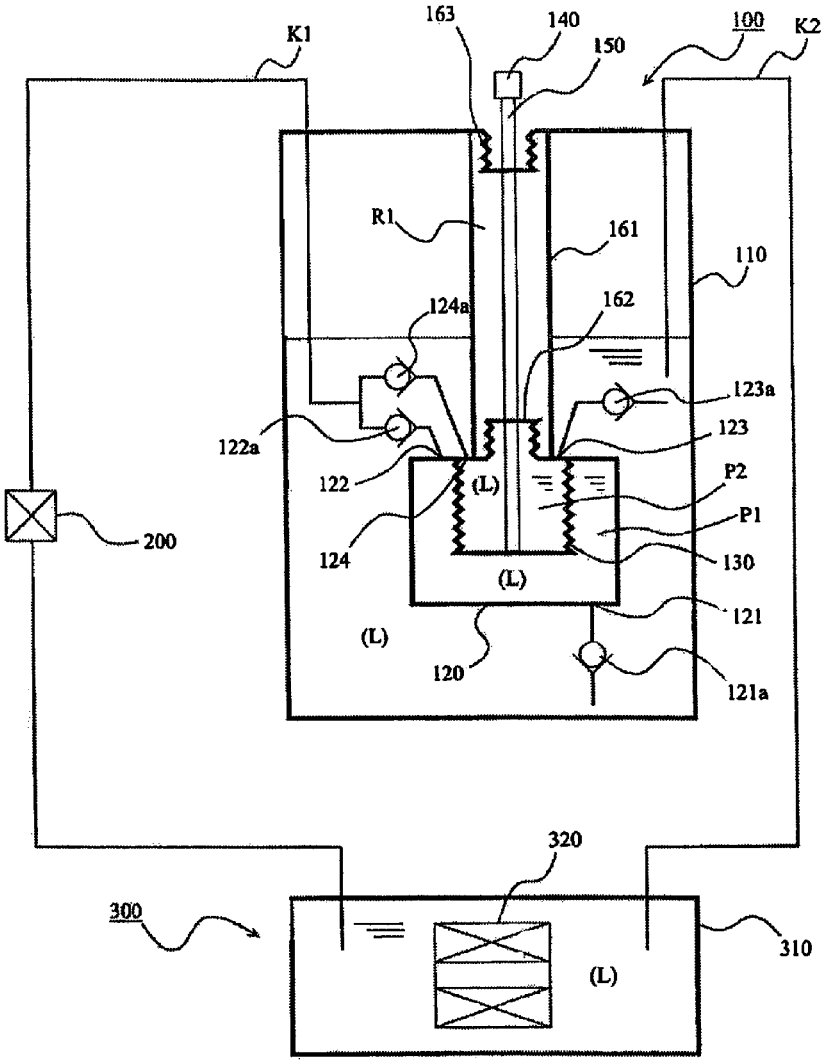
FIG. 1 is a schematic block diagram showing a state of use of a liquid supply system according to Embodiment 1 of the present disclosure.

With reference to FIG. 1, a liquid supply system according to Embodiment 1 of the disclosure will be described.

<Liquid Supply System>

With reference to FIG. 1, an overall structure and how to use the liquid supply system 100 according to Embodiment 1 of the present disclosure will be described. In the liquid supply system 100 according to the invention, as in the prior art, supply of ultracold liquid L to a cooled device 300 including a superconducting coil 320 in a rein vessel 310 will be described as an example. Specific examples of the ultracold liquid L are liquid nitrogen and liquid helium.

The liquid supply system 100 includes a first vessel 110 for housing the ultracold liquid L, a second vessel 120 disposed in the liquid L housed in the first vessel 110, and a bellows 130 disposed to enter the second vessel 120. An area in the second vessel 120 and outside the bellows 130 forms a first pump chamber P1. An inside of the bellows 130 is a sealed space and the sealed space serves as a second pump chamber P2. The second vessel 120 is provided with a first intake port 121 for taking the liquid L in the first vessel 110 into the first pump chamber P1 and a first delivery port 122 for delivering the taken-in liquid L from inside the first pump chamber P1 into a supply passage (supply pipe) K1 communicating with an outside of the system. The second vessel 120 is also provided with a second intake port 123 for taking the liquid L in the first vessel 110 into the second pump chamber P2 and a second delivery port 124 for delivering the taken-in liquid L from inside the second pump chamber P2 into a supply passage K1. The first intake port 121 and the second intake port 123 are respectively provided with one-way valves 121*a* and 123*a* and the first delivery port 122 and the second delivery port 124 are respectively provided with one-way valves 122*a* and 124*a*.

A shaft 150 which is reciprocated by a linear actuator 140 as a driving source enters the bellows 130 from outside the first vessel 110 and a tip end of the shaft 150 is fixed to a tip end of the bellows 130. In this way, when the shaft 150 reciprocates, the bellows 130 expands and contracts.

In the present embodiment, a sealed space R1 filled with gas is formed around the shaft 150. The sealed space R1 is formed by a cylindrical (preferably circular cylindrical) pipe portion 161 through which the shaft 150 extending from outside the first vessel 110 to reach the bellows 130 is inserted and small bellows 162 and 163 respectively provided to a lower end portion and an upper end portion of the pipe portion 161. The small bellows 162 separating the sealed space R1 and the second pump chamber P2 from each other and the small bellows 163 separating the sealed space R1 and an outside space from each other respectively have tip ends fixed to the shaft 150 and expand and contract as the shaft 150 reciprocates. The small bellows 162 and 163 respectively have smaller outer diameters than the bellows 130.

In the embodiment, the small bellows 162 is provided on the upper end side of the bellows 130 as described above to form the inside of the bellows 130 as the sealed space and this sealed space serves as the second pump chamber P2 as described above.

With the above structure, if the bellows 130 contracts, the liquid L is delivered from inside the second pump chamber P2 into the supply passage K1 through the second delivery port 124 and the liquid L is taken into the first pump chamber P1 through the first intake port 121. If the bellows 130 expands, the liquid L is taken into the second pump chamber P2 through the second intake port 123 and the liquid L is delivered from inside the first pump chamber P1 into the supply passage K1 through the first delivery port 122. In this manner, the liquid L is delivered into the supply passage K1 both when the bellows 130 contracts and expands.

As described above, in the liquid supply system 100 according to the embodiment, by repetition of expansion and contraction of the bellows 130, the liquid L is supplied to the cooled device 300 through the supply passage K1. Moreover, a return passage (return pipe) K2 connecting the liquid supply system 100 and the cooled device 300 is provided as well and the same amount of liquid L as that supplied to the cooled device 300 is returned to the liquid supply system 100. A cooling device 200 for cooling the liquid L into the ultracold state is provided at a position of the supply passage K1. With this structure, the liquid L cooled to an ultracold temperature by the cooling device 200 circulates between the liquid supply system 100 and the cooled device 300.

Advantages of the Liquid Supply System According to the Embodiment

As described above, in the liquid supply system 100 according to the embodiment, the inside of the bellows 130 is formed as the sealed space which serves as the second pump chamber P2. In this way, the liquid L is delivered into the supply passage K1 both when the bellows 130 contracts and expands, which doubles the amount of liquid supplied by the expansion and contraction of the bellows 130 as compared with the case in which the pump function is performed only by the first pump chamber P1. As a result, it is possible to reduce the amount of liquid supplied at one time by half as compared with the case in which the pump function is performed only by the first pump chamber P1, which reduces the maximum pressure of the liquid in the supply passage K1 by about half. Therefore, it is possible to suppress an adverse influence by pressure variation (pulsations) of the supplied liquid.

Moreover, while the liquid L is intermittently supplied when the pump function is performed only by the first pump chamber P1, the liquid L is supplied both when the bellows 130 contracts and expands in the embodiment. Therefore, the liquid L is supplied continuously, which suppresses the pulsations themselves. As a result, it is possible to save space as compared with the case in which a damper is provided outside the system, which reduces the portion where the heat exchange is carried out to increase the cooling efficiency.

Furthermore, in the embodiment, the inside of the cylindrical pipe portion 161 through which the shaft 150 is inserted is formed as the sealed space R1 and the sealed space R1 is filled with the gas. Because the sealed space R1 filled with the gas performs a function of preventing heat transfer, it is possible to suppress transfer of heat generated in the linear actuator 140 and atmospheric heat to the liquid L. Even if the heat is transferred to the liquid L to vaporize the liquid L, new liquid L is constantly supplied to exert cooling effect, which suppresses increase the temperature of the liquid L in the pump chamber to such a temperature that the liquid L is vaporized. Therefore, deterioration of the pump function can be prevented.

Moreover, even if the heat transfer from the shaft 150 or the like causes vaporization of the liquid L in the bellows 130 to generate gas and deteriorates the pump function by the second pump chamber P2, the pump function by the first pump chamber P1 can be performed stably. Furthermore, as compared with the prior art in which the gas (which is compressible fluid) exists inside the bellows 530, the liquid L (which is incompressible fluid) exists both inside and outside the bellows 130 in the embodiment and therefore it is possible to suppress whirling and buckling of the bellows 130 when the bellows 130 expands and contracts.

In the embodiment, the sealed space R1 is formed by the pipe portion 161 and the pair of small bellows 162 and 163. Both of the small bellows 162 and 163 have the tip ends fixed to the shaft 150 and expand and contract as the shaft 150 reciprocates. Therefore, the sealed space R1 is formed without forming sliding portions, which avoids generation of heat caused by frictional resistance due to sliding.

Although the sealed space R1 is filled with the gas in the above-described embodiment, the inside of the sealed space R1 may be evacuated. By evacuating the inside of the sealed space R1, it is possible to further increase heat insulating effect.

Embodiment 2

Figure 2:
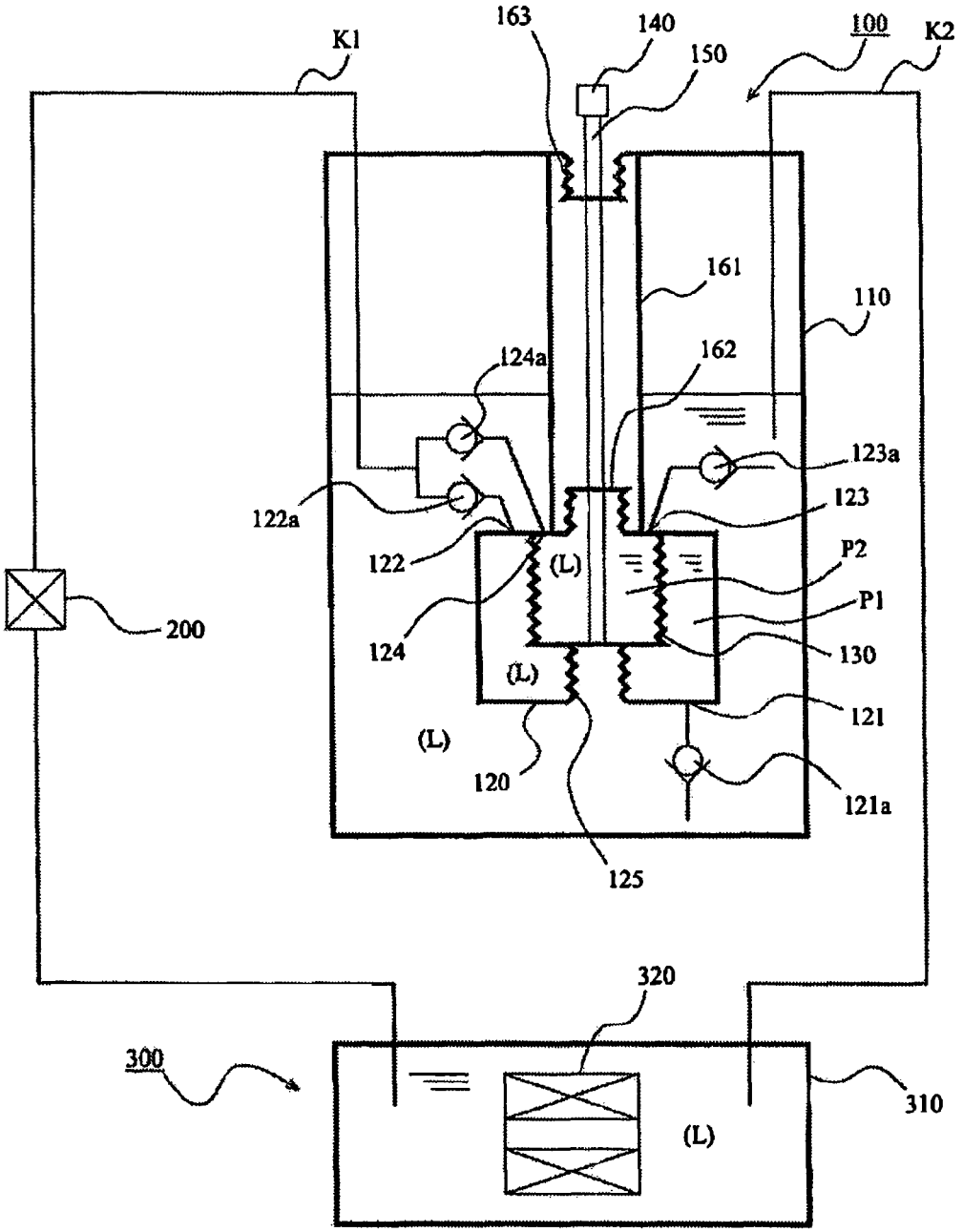
FIG. 2 is a schematic block diagram showing a state of use of a liquid supply system according to Embodiment 2 of the present disclosure.

FIG. 2 shows Embodiment 2 of the present disclosure. In the present embodiment, a structure in which a small bellows is provided below a bellows will be described. The other structures and operations are the same as those in Embodiment 1 and therefore the same components will be provided with the same reference numerals and will not be described.

In the embodiment, a bottom side of a second vessel 120 and a bellows 130 are connected by the small bellows 125 which communicates with an inside of a first vessel 110, expands and contracts as a shaft 150 reciprocates, and has a smaller outer diameter than the bellows 130.

If the structure shown in Embodiment 1 described above is employed, a pump rate (discharge rate) of the first pump chamber P1 is greater than a pump rate of the second pump chamber P2. For smaller pressure variation (pulsations), it is preferable that a difference between the pump rates is small.

Here, a pressure receiving area of an effective diameter of the bellows 130 is represented by S1 and a pressure receiving area of an effective diameter of the small bellows 162 is represented by S2 in Embodiment 1 and Embodiment 2. A pressure receiving area of an effective diameter of the small bellows 125 is represented by S3 in Embodiment 2. And a moving distance of the shaft is represented by L. If the effective diameter of the bellows 130 is represented by D1, the effective diameter of the small bellows 162 is represented by D2, and the effective diameter of the small bellows 125 is represented by D3, $$S1=\pi\times(D1)^2\div4, S2=\pi\times(D2)^2\div4, \text{and } S3=\pi\times(D3)^2\div4.$$

In Embodiment 1, the pump rate of the first pump chamber P1 is S1×L and the pump rate of the second pump chamber P2 is (S1−S2)×L.

In Embodiment 2, on the other hand, the pump rate of the first pump chamber P1 is (S1−S3)×L and the pump rate of the second pump chamber P2 is (S1−S2)×L.

Therefore, by providing the small bellows 125, it is possible to reduce the difference between the pump rate of the first pump chamber P1 and the pump rate of the second pump chamber P2. By equalizing S2 and S3 with each other, it is theoretically possible to equalize the pump rate of the first pump chamber P1 and the pump rate of the second pump chamber P2 with each other, which further effectively suppresses the pulsations.

Embodiment 3

Figure 3:
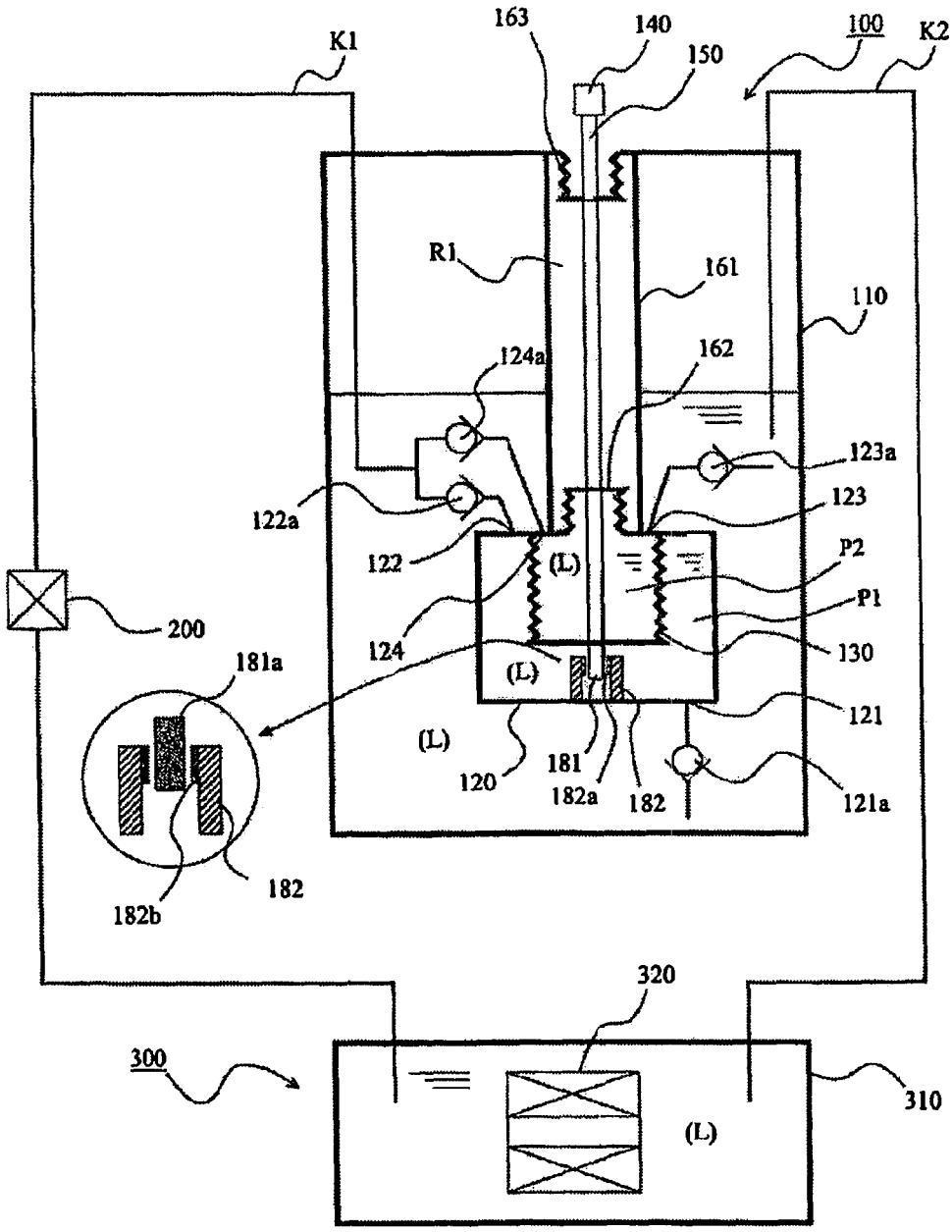
FIG. 3 is a schematic block diagram showing a state of use of a liquid supply system according to Embodiment 3 of the present disclosure.

FIG. 3 shows Embodiment 3 of the invention. In the embodiment, a case in which a structure for suppressing displacement of axes is provided below a bellows will be described. The other structures and operations are the same as those in Embodiment 1 and therefore the same components will be provided with the same reference numerals and will not be described.

In the embodiment, a shaft member 181 is provided to a lower send portion of the bellows 130 and a bearing 182 of the shaft member 181 is provided to a bottom of a second vessel 120. The bearing 182 is formed by an annular member and a bearing member 182*a* is provided to an inner peripheral portion of a tip end of the bearing 182. The other structures are the same as those in Embodiment 1 and therefore will not be described. Through holes are preferably provided in a side face of the bearing 182 to allow the liquid L to freely flow into and out of the bearing 182. In this way, it is possible to suppress obstruction of reciprocation of the shaft 150.

With the above-described structure, in the embodiment, it is possible to suppress displacement of axes of the shaft 150 and the bellows 130. In this way, it is possible to suppress displacement of the bellows 130 in a radial direction to suppress damage to the bellows 130. Moreover, it is possible to suppress contact of the shaft 150 with small bellows 162 and 163 to suppress impairment of buffering functions.

Because the shaft 150 protrudes below a bottom of the bellows 130, part of the shaft 150 can function as the shaft member 181. As shown in an encircled part in FIG. 3, a shaft member 181*a* may be formed by permanent magnets and the bearing member 182*a* provided to the tip end of the bearing 182 may be formed by a permanent magnet so that the shaft member 181*a* and the bearing member 182*a* repel each other with magnetic forces. In this way, it is possible to suppress contact between the shaft member 181*a* and the bearing member 182*a* to further suppress the displacement of the axes. Although the shaft member is provided on the bellows 130 side and the bearing is provided to the bottom of the second vessel 120 in the embodiment, the shaft member may be provided to the bottom of the second vessel 120 and the bearing may be provided on the bellows 130 side. Arrangements and the number of shaft members and bearings can be set arbitrarily. For example, the structure shown in the embodiment may be employed in the structure shown in Embodiment 2 described above. In this case, the shaft member and the bearing need to be disposed at positions displaced from a center of the bellows 130 unlike in FIG. 3 in which the shaft member and the bearing are positioned near the center.

Embodiment 4

Figure 4:
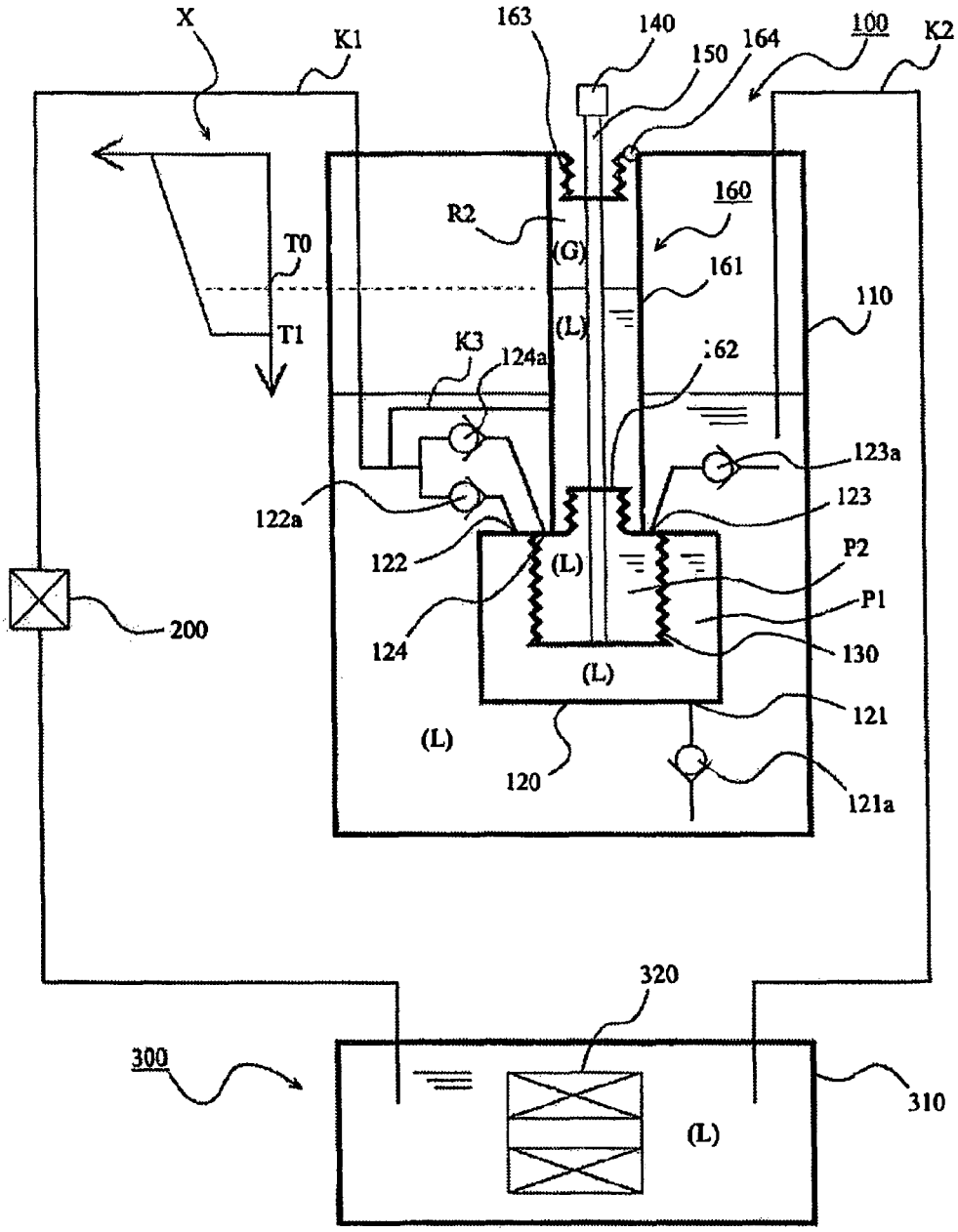
FIG. 4 is a schematic block diagram showing a state of use of a liquid supply system according to Embodiment 4 of the present disclosure.
Figure 5:
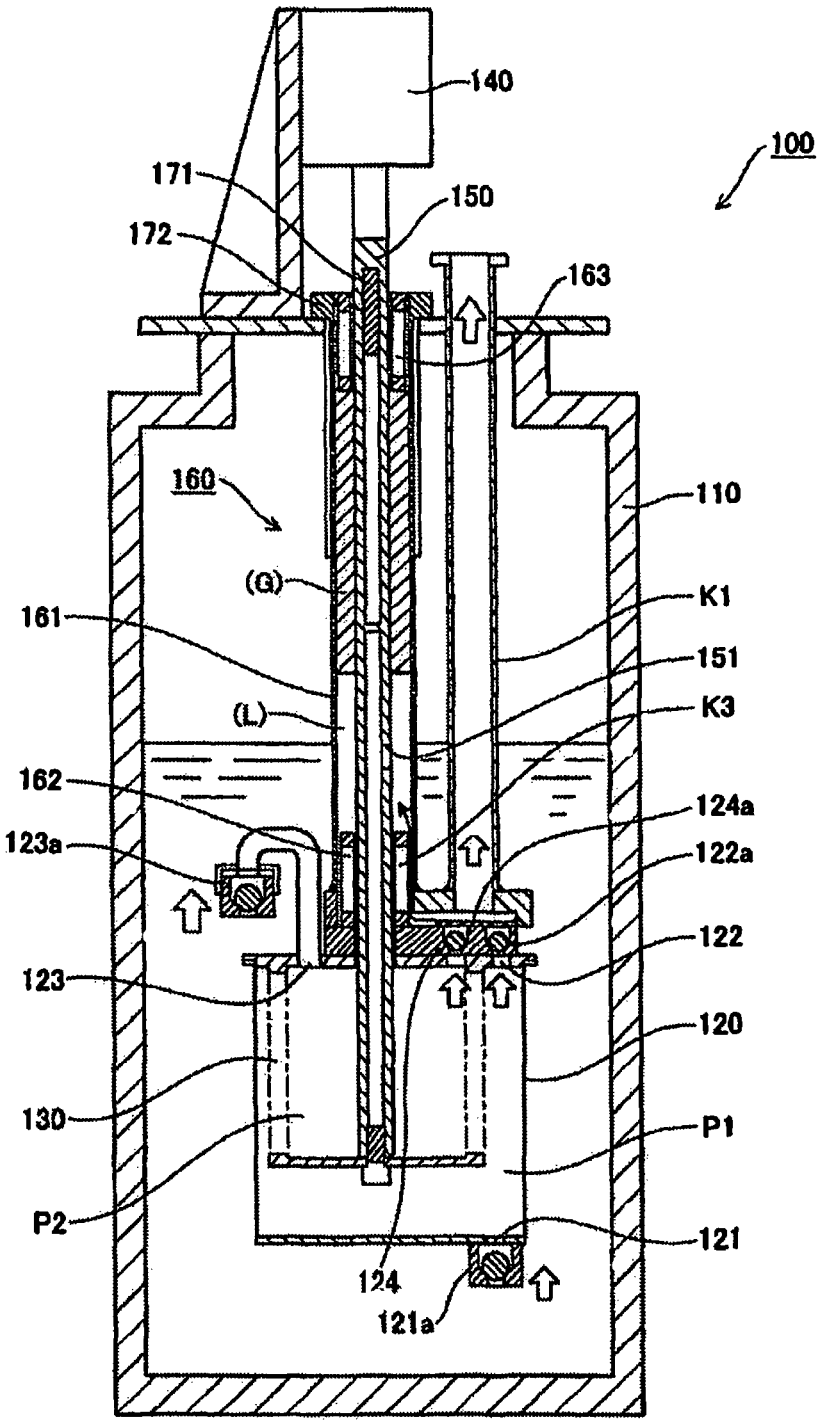
FIG. 5 is a diagrammatic sectional view of the liquid supply system according to Embodiment 4 of the present disclosure.
Figure 6A:
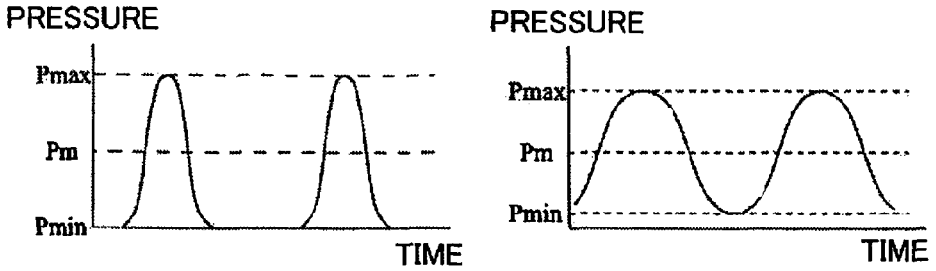
FIG. 6 is a graph showing pressure variation.
Figure 6B:
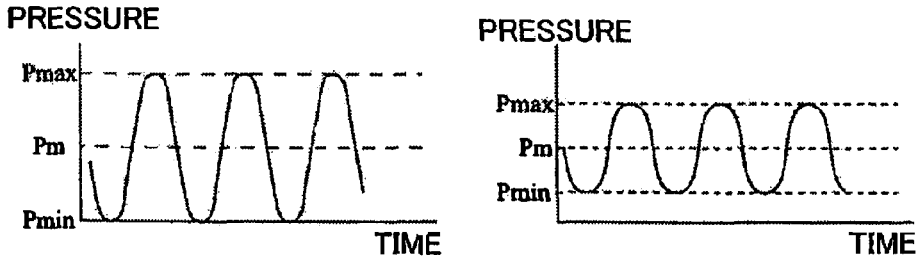
Figure 6C:
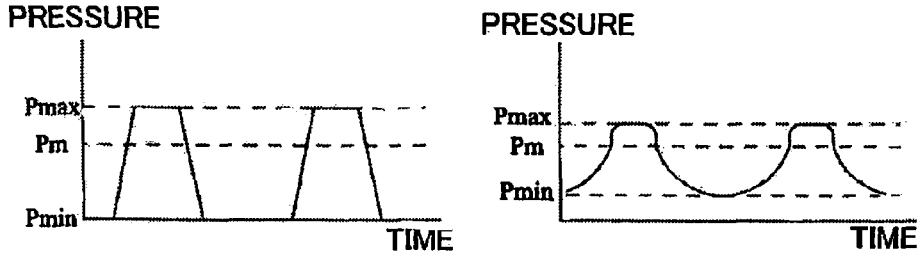
Figure 6D:
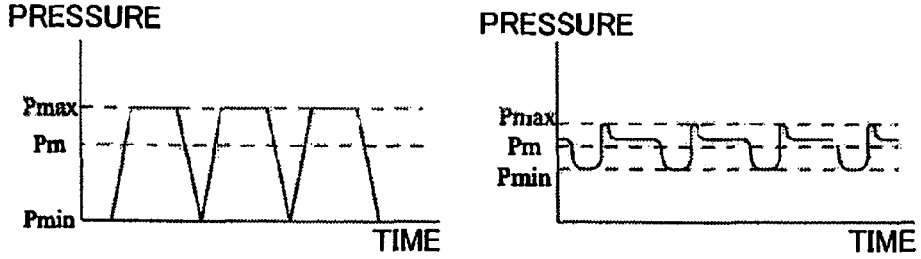
Figure 7:
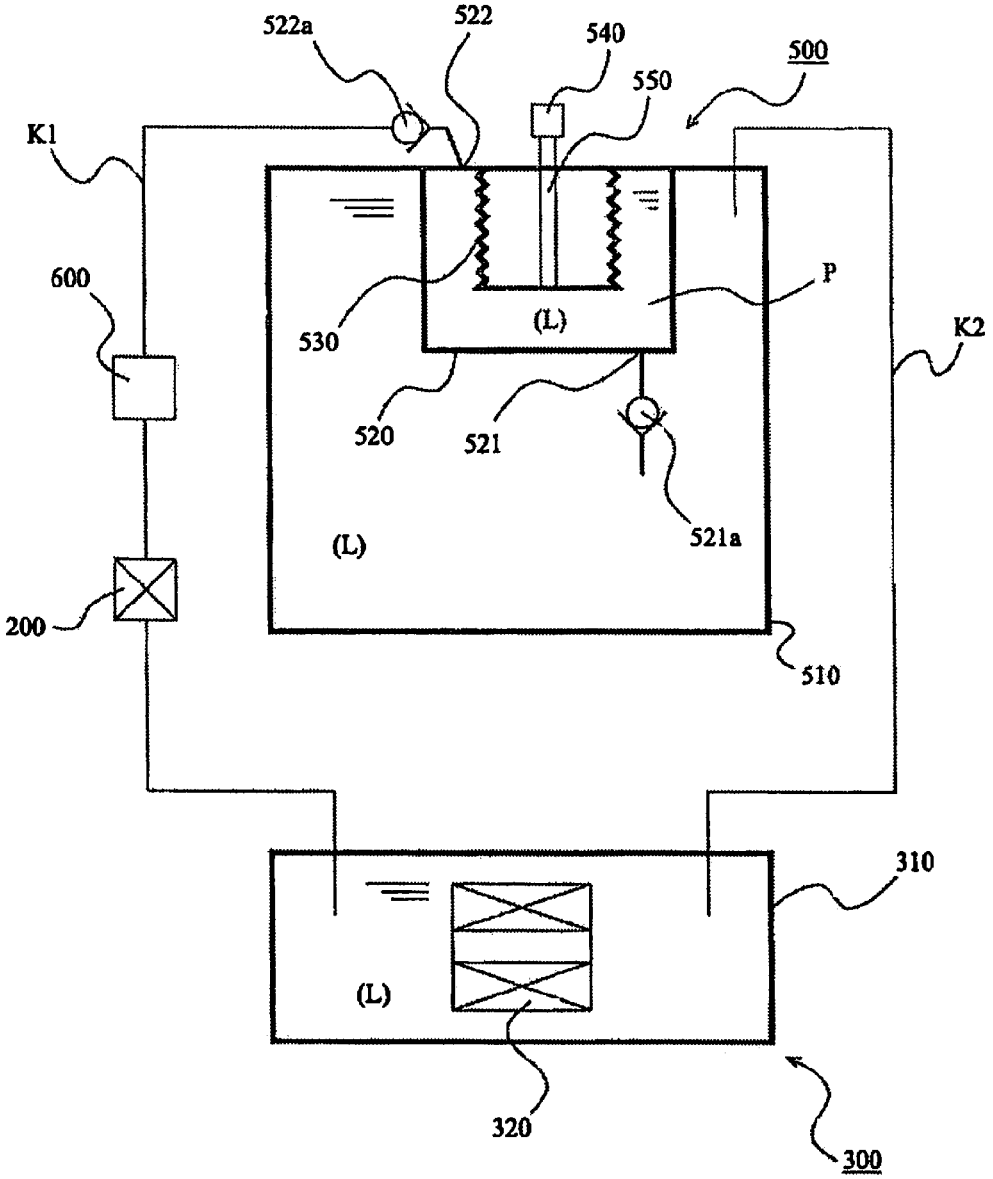
Fig. 7 PRIOR ART
FIG. 7 is a schematic block diagram showing a state of use of the prior-art liquid supply system.

With reference to FIGS. 4 and 5, a liquid supply system according to Embodiment 4 of the invention will be described. While the sealed space through which the shaft is inserted is filled with the gas or evacuated in Embodiment 1 described above, a layer of liquid and a layer of gas are formed in the sealed space to function as a gas damper in the embodiment. The other structures and operations are the same as those in Embodiment 1 and therefore the same components will be provided with the same reference numerals and will not be described.

In the present embodiment, a buffer structure 160 for buffering variation (pulsations) of pressure of liquid L supplied through the supply passage K1 is provided around the shaft 150. The buffer structure 160 includes a cylindrical (preferably circular cylindrical) pipe portion 161 through which a shaft 150 extending from outside a first vessel 110 to reach a bellows 130 is inserted and small bellows 162 and 163 respectively provided to a lower end portion and an upper end portion of the pipe portion 161. The pipe portion 161 and the pair of small bellows 162 and 163 form a sealed space R2 inside themselves. The small bellows 162 separating the sealed space R2 and a second pump chamber P2 from each other and the small bellows 163 separating the sealed space R2 and an outside space from each other respectively have tip ends fixed to the shaft 150 and expand and contract as the shaft 150 reciprocates. The small bellows 162 and 163 respectively have smaller outer diameters than the bellows 130.

In the sealed space R2, the layer of the liquid L and the layer of the gas G formed by vaporization of the liquid L are formed. In FIG. 4, a graph shows a temperature gradient in the sealed space R2 (X in the drawing). As shown in this graph, a lower portion in the sealed space R2 is stable at temperature T1 (about 70 K in a case of liquid nitrogen) and the temperature increases toward an upper portion which is exposed to the outside air. Near a saturation temperature T0 (about 78 K in the case of liquid nitrogen), an interface between the layer of the liquid L and the layer of the gas G is formed.

A branch passage K3 branching off the supply passage K1 is connected to the sealed space R2. As a result, pressure of the liquid L supplied through the supply passage K1 is also applied to an inside of the sealed space R2 and therefore the gas in the sealed space R2 functions as the damper to buffer the variation (pulsations) of the pressure of the liquid L supplied through the supply passage K1.

In the buffer structure 160 according to the embodiment, a safety valve 164 for allowing internal pressure to escape to the outside when the pressure in the sealed space R2 becomes equal to or higher than predetermined pressure is provided near the small bellows 163. In this way, even if the pressure in the sealed space R2 becomes abnormally high due to increase of an amount of the vaporized gas G or the like in the sealed space R2, it is possible to allow the pressure to escape. Therefore, it is possible to suppress breakage of the pipe portion 161 and the small bellows 162 and 163 due to abnormally high internal pressure.

With reference to FIG. 5, a more concrete example of the liquid supply system 100 according to the embodiment will be described. FIG. 5 is a diagrammatic sectional view of the liquid supply system 100 according to the embodiment of the invention disclosure and taken along an axis of the shaft 150. In the sectional view in FIG. 5, a return passage (return pipe) K2 is not shown.

In the example shown in FIG. 5, a hollow shaft is employed as the shaft 150. In this way, it is possible to reduce the shaft 150 in weight. Moreover, because a sectional area is reduced, it is possible to suppress transfer of atmospheric heat to the inside by the shaft 150. The shaft 150 is provided with a relief hole 151 connecting the inner hollow portion and the outside of the shaft 150. Therefore, it is possible to suppress breakage of the shaft 150 caused by a sudden rise in the internal pressure due to vaporization of the liquid entering the hollow inside through a crack or the like.

In the example shown in FIG. 5, heaters 171 and 172 are provided near the small bellows 163 (specifically, in the hollow inside of the shaft 150 and on an outer periphery side near an end portion of the shaft 150 on an atmosphere side). In this way, temperature in the sealed space R2 can be adjusted and it is possible to suppress (prevent) adhesion of frost and lumps of ice to the small bellows 163 during operation.

As described above, according to the liquid supply system 100 in the embodiment, the buffer structure 160 for buffering the variation (pulsations) of the pressure of the liquid L supplied through the supply passage (supply pipe) K1 is provided in the system. Therefore, as compared with the above-described respective embodiments, it is possible to further suppress the pulsations.

In the embodiment, as the buffer structure 160, the inside of the cylindrical pipe portion 161 through which the shaft 150 is inserted is formed as the sealed space R2 and the layer of the liquid L and the layer of the gas G are formed in the sealed space R2. As a result, the layer of the gas G performs the function of preventing heat transfer and therefore it is possible to suppress transfer of the heat generated in the linear actuator 140 and atmospheric heat to the liquid L. Even if the heat is transferred to the liquid L to vaporize the liquid L, new liquid L is constantly supplied to exert cooling effect, which only results in increase in a thickness of the layer of the gas G for performing the buffering function (the function as the gas damper) in the sealed space R2. Therefore, it is possible to suppress increase of the temperature of the liquid L in the pump chamber to such a temperature that the liquid L is vaporized in the pump chamber and deterioration of a pump function can be prevented. In the prior art, if the heat is transferred by the shaft to vaporize the liquid in the second vessel 520, the generated gas is pushed out or the gas portion is compressed in a compression process of the bellows, thereby leading to reduction in pump efficiency, while this problem does not occur in the embodiment.

Furthermore, in the example shown in FIG. 5, the heaters 171 and 172 capable of adjusting the temperature in the sealed space R2 in the pipe portion 161 are provided. Therefore, it is possible to adjust thicknesses of the layer of the liquid L and the layer of the gas G according to the pulsations that would occur if the damper was not provided to effectively suppress the variation (pulsations) of the pressure.

In the embodiment, if the small bellows 125 is provided below the bellows 130 as shown in Embodiment 2 described above, it is possible to further suppress the pulsation. Moreover, if the structure for suppressing the displacement of the axes is provided as shown in Embodiment 3 described above, it is possible to suppress the displacement of the axes to allow the damper function to be performed stably.

<Amount of Gas in Gas Damper>

Here, in the embodiment, an amount of the gas required to cause the inside of the sealed space R2 to effectively function as the gas damper will be described briefly.

<<When Pressure Variation is in Sine Curve Form>>

When the pressure variation is in a sine curve form, the amount V1 of the gas required to cause the inside of the sealed space R2 to effectively function as the gas damper is $$V1=\{q\times K\times(Pm\div P1)^{1/n}\}\div\{1-(Pm\div P2)^{1/n}\} \quad [1]$$

Here, q represents a discharge rate [l] per a single reciprocation and K represents a constant according to a pump type and is 0.25 in a case of a single double-action reciprocating pump as in the embodiment. Pm represents discharge average pressure [MPa] and P1 representing sealed gas pressure is (0.6 to 0.8)×Pm [MPa] when a temperature does not change. For example, P1=0.7×Pm [PMa]. n represents a polytropic index and is 1.41 when the gas is nitrogen gas.

Furthermore, P2 represents target maximum pipe internal pressure and $$P2=\{1+(\text{pulsation rate}\div 100)\}\times Pm[\text{Mpa}]$$

The "pipe" corresponds to the supply passage K1 and the return passage K2 in the embodiment. The "pulsation rate" refers to a value obtained by dividing a pressure difference between the target maximum pipe internal pressure and the discharge average pressure by the discharge average pressure. In other words, the "pulsation rate"={(P2−Pm)÷Pm}×100.

<<When Pressure Variation is in Square Wave Form>>

When the pressure variation is a square wave form, the amount V2 of the gas required to cause the inside of the sealed space R2 to effectively function as the gas damper is $$V2=Va\times(Pa\div P1)$$

Here, Pa represents pressure (normal operation pressure) in the pipe (the supply passage K1 and the return passage K2) when shock pressure is not applied. P1 is (0.8 to 0.9)×Pa [MPa]. For example, P1=0.9×Pa [MPa].

Va representing a gas amount when the pressure is Pa is $$Va=\{W\times v^2\times(n-1)\}\div\{200\times Pa\times((Pb/Pa)^{(n-1)/n}-1\}$$

Here, W represents a fluid mass in the pipes (the supply passage K1 and the return passage K2) and $W=(\pi/4)\times d^2\times L\times \rho\times 10^{-6}$ [kg]. d represents a diameter (inner diameter) [mm] of the pipes and L represents a length [m] of the pipes, and ρ represents a fluid density [kg/m$^3$]. v represents a flow velocity and $v=21.23\times Q/d^2$ [m/s]. Here, the flow velocity v is an average flow velocity in the supply passage K1 and the return passage K2. Q represents a flow rate [l/min]. n represents a polytropic index and is 1.41 when the gas is nitrogen gas. Furthermore, Pb represents permissible shock pressure and is the maximum permissible shock pressure. The permissible shock pressure Pb is normally set to 110% of the normal operation pressure Pa. In other words, Pb=1.1×Pa [MPa].

Comparison Between Prior Art and Embodiments

With reference to FIGS. 6(*a*) to 6(*d*), comparison results between pressure variation (pulsations) in the prior art and the above-described respective embodiments will be described. In FIGS. 6(*a*) to 6(*d*), the variation in the pressure (vertical axis) with respect to elapsed time (horizontal axis) is shown in graphs.

FIG. 6(*a*) shows cases in which the pressure variation is in the sine curve form in the prior art (when the pump function is performed only by the first pump chamber), wherein the left drawing shows a case in which the damper is not provided and the right drawing shows a case in which the damper is provided.

FIG. 6(*b*) shows cases in which the pressure variation is in the sine curve form in the embodiment (when the pump function is performed by the first pump chamber and the second pump chamber), wherein the left drawing shows a case in which the damper is not provided (Embodiments 1 to 3) and the right drawing shows a case in which the damper is provided (Embodiment 4). Here, as described above, if the amount of gas is set to an amount satisfying the above-described expression of V1, it is possible to suppress the difference between Pmax and Pmin to 30% or lower (pulsation rate of 30% or lower) as compared with the case in which the damper is not provided.

FIG. 6(*c*) shows cases in which the pressure variation is in the square wave form in the prior art (when the pump function is performed only by the first pump chamber), wherein the left drawing shows a case in which the damper is not provided and the right drawing shows a case in which the damper is provided.

FIG. 6(*d*) shows cases in which the pressure variation is in the square wave form in the embodiment (when the pump function is performed by the first pump chamber and the second pump chamber), wherein the left drawing shows a case in which the damper is not provided (Embodiments 1 to 3) and the right drawing shows a case in which the damper is provided (Embodiment 4). Here, as described above, if the amount of gas is set to an amount satisfying the above-described expression of V2, it is possible to suppress the difference between Pmax and Pmin to 30% or lower (pulsation rate of 30% or lower) as compared with the case in which the damper is not provided. Although the graphs are simplified in the basic application (Japanese Patent Application No. 2011-56426), to put it more concretely, the pressure rises to reach Pmax for an instant and then drops as shown in FIG. 6(*d*), if the damper is provided.

If the linear actuator drives the shaft 150 with a crank shaft or the like not at a constant velocity, the pressure variation is in a waveform like the sine curve. If the shaft 150 is driven at a constant velocity, the pressure variation is in the square wave form.

As is clear from the graphs in FIGS. 6(*a*) to 6(*d*), if the pump function is performed by the first pump chamber and the second pump chamber, the pressure variation (pulsations) can be suppressed. It is possible to effectively suppress the pressure variation especially in the case of the square wave. As in Embodiment 4, by providing the damper in the system, it is possible to effectively suppress the pressure variation in cooperation with suppression of the pressure variation itself.

REFERENCE SIGNS LIST

100 liquid supply system
110 first vessel
120 second vessel
121 first intake port
122 first delivery port
123 second intake port
124 second delivery port
121*a*, 122*a*, 123*a*, 124*a* one-way valve
130 bellows
140 linear actuator
150 shaft
151 relief hole
160 buffer structure
161 pipe portion
162, 163 small bellows
164 safety valve
171, 172 heater
181, 181*a* shaft member
182 bearing
182*a*, 182*b* bearing member
200 cooling device
300 cooled device
310 vessel
320 superconducting coil
K1 supply passage
K2 return passage
K3 branch passage
L liquid
P1 first pump chamber
P2 second pump chamber
R1, R2 sealed space

The invention claimed is:

1. A liquid supply system comprising:

a first vessel in which ultracold liquid is housed;

a second vessel disposed within the liquid in the first vessel to take in the liquid from the first vessel and to deliver the liquid into a supply passage communicating with an outside of the liquid supply system;

a first bellows disposed to enter the second vessel; and a shaft formed to be reciprocated by a driving source to cause the first bellows to expand and contract, wherein an outside of the first bellows in the second vessel serves as a first pump chamber provided with a first intake port for taking the liquid in the first vessel into the first pump chamber and a first delivery port for delivering the liquid from inside the first pump chamber into the supply passage, and an inside of the first bellows serves as a second pump chamber formed by a sealed space and provided with a second intake port for taking the liquid in the first vessel into the second pump chamber and a second delivery port for delivering the liquid from inside the second pump chamber into the supply passage.

2. The liquid supply system according to claim 1, wherein a further sealed space is formed through which the shaft extending from outside the first vessel to reach the first bellows is inserted, an inside of the further sealed space being filled with gas.

3. The liquid supply system according to claim 1, wherein a further sealed space is formed through which the shaft extending from outside the first vessel to reach the first bellows is inserted, an inside of the further sealed space being evacuated.

4. The liquid supply system according to claim 1, wherein a further sealed space is formed through which the shaft extending from outside the first vessel to reach the first bellows is inserted, a layer of the liquid and a layer of gas are formed in the further sealed space, and a branch passage branching off the supply passage is connected to the further sealed space to form a buffer structure for buffering pressure variation of the liquid supplied through the supply passage.

5. The liquid supply system according to claim 4, wherein the buffer structure is provided with a safety valve for allowing internal pressure to escape when the pressure in the further sealed space through which the shaft is inserted becomes equal to or higher than a predetermined pressure.

6. The liquid supply system according to claim 1, wherein a further sealed space is formed through which the shaft extending from outside the first vessel to reach the first bellows is inserted, the further sealed space and the second pump chamber are separated by a small second bellows, the further sealed space and an outside space are separated by a small third bellows, and both the small second bellows and the small third bellows expand and contract as the shaft reciprocates and have smaller outer diameters than the first bellows.

7. The liquid supply system according to claim 6, wherein a heater for adjusting a temperature is provided near the small third bellows separating the further sealed space and the outside space.

8. The liquid supply system according to claim 1, wherein a shaft member and a bearing of the shaft member are provided below the first bellows.

9. The liquid supply system according to claim 1, wherein a bottom side of the second vessel and the first bellows are connected by a small second bellows which communicates with an inside of the first vessel, expands and contracts as the shaft reciprocates, and has a smaller outer diameter than the first bellows.

* * * * *